US006010418A

United States Patent [19]

Lekavich

[11] Patent Number: 6,010,418

[45] **Date of Patent: *Jan. 4, 2000**

[54] GAME PUCK WITH IMPROVED GLIDER PIN

[76] Inventor: Carl Lekavich, Ideal Design Sports Inc., 215 Menlo Ave., Torrance, Calif. 90502

[ * ] Notice: This patent is subject to a terminal disclaimer.

[21] Appl. No.: 08/990,719

[22] Filed: Dec. 15, 1997

Related U.S. Application Data

[63] Continuation-in-part of application No. 08/512,759, Aug. 9, 1995, Pat. No. 5,697,858.

[51] Int. Cl.[7] ..... A63B 1/00

[52] U.S. Cl. ..... 473/588

[58] Field of Search ..... 473/588, 589; 411/338, 339, 510

[56] References Cited

U.S. PATENT DOCUMENTS

| | | |
|---|---|---|
| 150,060 | 4/1874 | Lapham . |
| 607,315 | 7/1898 | Wingard . |
| 1,418,314 | 6/1922 | McBee . |
| 2,201,551 | 5/1940 | Welk . |
| 3,675,928 | 7/1972 | Gentile . |
| 3,726,526 | 4/1973 | Radovich . |
| 3,784,204 | 1/1974 | Felber . |
| 4,078,801 | 3/1978 | White, Sr. . |
| 4,111,419 | 9/1978 | Pellegrino . |
| 4,793,769 | 12/1988 | Dolan . |
| 5,074,696 | 12/1991 | Tanaka . |
| 5,207,720 | 5/1993 | Shepherd . |
| 5,275,410 | 1/1994 | Bellehumeur et al. . |
| 5,366,219 | 11/1994 | Salcer et al. . |
| 5,482,274 | 1/1996 | Bellehumeur . |
| 5,697,858 | 12/1997 | Lekavich ..... 473/588 |

*Primary Examiner*—Raleigh W. Chiu
*Attorney, Agent, or Firm*—Richard C. Litman

[57] ABSTRACT

A game puck including a puck body having a plurality of throughbores radially disposed therein, each receiving a diagonally split glide pin. The glide pins each have heads which protrude from each face of the puck. Each pin has a diagonally split shank defining a plurality of mating teeth and a predetermined total shank diameter when joined. Each component has an inclined toothed or serrated surface which mates with a like component, each component having a tip diameter which is substantially less than one-half of the diameter of the total shank diameter. Thus when a pair of pin components are abutted at the tip, a reduced diameter is defined which approximates two thirds or less of the total shank diameter. This diameter permits insertion of a pin component into each mouth of a puck throughbore and joinder of the pin in a manner which, first, as the tips abut, permit a large margin of space to avoid insertion damage at the mouth of the aperture, and, second, as the tips are driven by one another in opposing directions, cause the pin to reach a total shank diameter that not only matches the aperture diameter, but may actually slightly exceed the diameter of the aperture to the extent of micrometer tolerances.

8 Claims, 4 Drawing Sheets

GAME PUCK WITH IMPROVED GLIDER PIN

CROSS-REFERENCE TO RELATED APPLICATION

This application is a continuation-in-part of application Ser. No. 08/512,759 filed Aug. 9, 1995, now U.S. Pat. No. 5,697,858 issued Dec. 16, 1997.

BACKGROUND OF THE INVENTION

1. Field of the Invention

This invention relates to games involving projectiles employing glide pins. More specifically, the present invention relates to a puck employing a bipartite pin, each component having an angularly inclined toothed surface on its shank, which when joined within an aperture formed in the puck, forms a glide pin.

2. Description of the Prior Art

In-line skates have inspired renewed interest in playing street hockey. Similar to ice hockey, the players drive a puck into an opposing team's goal to score points. Unlike in ice hockey, the puck typically does not slide as easily along a street hockey playing surface, typically cement or asphalt, as it would on ice. Players often must retrace their paths to reclaim the reluctant projectile, slowing the game and making it less enjoyable. Many times, the puck flips up on edge and rolls across the playing surface rather than playing flat, or sliding along on one of the two faces. Another problem with using a conventional street hockey puck to play roller hockey is that it tends to rebound off objects with high energy at unpredictable trajectories. As roller hockey technology improves, players become less tolerant of inadequate playing action provided by conventional hockey pucks. A need exists for a puck that glides easily on a street or court hockey playing surface, tends to play flat, provides low-energy rebound action, provides long pin-life and discourages rolling on edge.

Such properties are largely dependent on the glide pins used during the manufacturing process. Due to the high shear forces exerted upon the puck during play, inadequately designed pins often cause pin heads to be sheared off and fall out, thus destroying the life and usefulness of the puck. Surface wear further causes the pin heads to wear down and cause the pin to fall out of the puck. However, manufacturing concerns, such as cost and speed of manufacturing each puck, act against the use of quality pins.

In many manufacturing processes, a molding process is used to inject hot, fluid plastic into a mold which provides a plurality of predetermined diameter apertures into the puck, each aperture being sized to exact tolerances to receive a pin shank. The head of the pin, whether recessed into the surface of the puck or not, resides above the general plane of the puck body, thereby elevating the puck permitting it to glide over surfaces with high coefficients of friction, such as a concrete surface. However, several factors cause problems to the successful insertion of such pins into the puck, which in turn effect the useful life and shear force resistance of pin within the puck.

First, as the plastic cools after injection, the plastic shrinks, thus causing the aperture formed to receive the pin to increase. This provides an potential advantage to a pin which can alter its diameter. For purposes of being inserted into a puck, a reduced diameter pin is desired; however, after final assembly, a pin having a snug fit within the aperture, and thus a diameter as close to that of the aperture, to grip the puck, is desired.

These conflicting desires present manufacturing problems. If the pin can be inserted early enough in the process, the plastic body shrink will result in a loss of gripping force upon the pin and increase the chance of its loss over the puck's life. However, during the shrinking process, the plastic is subject to damage by an improperly inserted pin, such as jabbing by a sharp object such as the pin's tip. Thus, unless a pin can be inserted without contact through the mouth of the aperture, the risk of a damaged puck is high, and consequently the process is slowed down until a threshold temperature is reached where a pin can be inserted without fear of damage.

Even then, a pin which must be inserted into a predetermined diameter aperture cannot have a shank diameter of greater than or closely approaching the aperture diameter and provide an expectation of an improved grip within the aperture against the wall of the puck body. None of the pucks in the prior art, nor bi-partite or split pins known in the art, are properly configured to serve the needs of the puck manufacturer. Thus, a need for an improved glide pin is seen.

Several types of game pucks are described in the patent literature. Unfortunately, the apparatuses described do not predispose a puck to the above described needs.

Most notably, U.S. Pat. No. 5,275,410, issued Jan. 4, 1994, to Alex R. Bellehumeur et al., and U.S. Pat. No. 5,482,274, issued Jan. 9, 1996 to Bellehumeur, describes a puck for use on a non-ice surface. The apparatus includes a solid core having an upper face, a lower face and an annular surface. The apparatus has a plurality of annular slots and throughbores radially diverged therethrough. The slots provide spring means that deform on impact. Stainless steel or polyurethane runners, i.e. glide pins, are received in each throughbore, each having head protruding above each face. One embodiment of a runner shows it formed in two pieces. In particular, as shown in FIG. 17 of the '410 patent, one piece has an axial bore with interior annular teeth that engage with the exterior annular teeth of the second piece inserted therein. However, such pin has a fixed diameter determined by one component part, and has an axial arrangement that prevents it from being used as described above. In essence, the throughbore will reach a predetermined diameter after cooling and only then can the runner be safely inserted into the throughbore without risking damaging contact with the sidewalls of the throughbore. Moreover, the pin must be inserted in nearly perfect coaxial and concentric alignment with the throughbore, and will still not derive the benefit of an tight fit.

Other less relevant pucks include, for example, U.S. Pat. No. 3,675,928, issued Jul. 11, 1972, to Salvatore A. Gentile, describes an impact safety game puck. The apparatus includes a solid core with a peripherally-disposed annular chamber. A second embodiment includes a thin disk having two faces and a wide, peripherally-disposed annular chamber, defining bowl-shaped cavities in each face of the disk.

U.S. Pat. No. 3,726,526, issued Apr. 10, 1973, to Leroy N. Radovich, describes a multi-purpose game puck. The device includes a solid core having an upper face, a lower face and an annular surface. The device has a central recess and a plurality of indented surfaces radially diverged in each face.

U.S. Pat. No. 3,784,204, issued Jan. 8, 1974, to Julius Felber, describes a hockey puck. The apparatus includes a solid core having an upper face, a lower face and an annular surface. The apparatus has central recesses in each face. The apparatus includes a plurality of spherical rollers radially diverged and slidingly maintained on each face.

U.S. Pat. No. 4,793,769, issued Dec. 27, 1988, to Michael Dolan, describes a hockey puck. The device includes a solid core having an upper face, a lower face and an annular surface. The device includes a plurality of ball bearings, radially diverged and slidingly received in the core. The ball bearings protrude through each face.

U.S. Pat. No. 5,207,720, issued May 4, 1993, to Charles G. Shepherd, describes a hockey puck device. The device includes a first housing and a second housing which threadingly interengage, defining a cavity. Gage means are disposed within the cavity for measuring impact forces.

U.S. Pat. No. 5,366,219, issued Nov. 22, 1994, to William Salcer et al., describes a hockey puck. The device includes an insert member over which plastic material is molded. The finished device has an upper face, a lower face and an annular surface. The insert has runners that protrude through and are radially diverged about the periphery of each face. The runners are constructed from nylon, possibly blended with "Kevlar™."

Other pucks failing to show the pin of the present invention include U.S. Pat. No. 4,111,419 issued to Pellegrino, U.S. Pat. No. 5,207,720 issued to Shepherd, and U.S. Pat. No. 4,078,801 issued to White, Sr.

Of the bipartite pins known in the prior art, U.S. Pat. No. 5,074,696 issued to Tanaka is notable in its split and toothed features. However, this pin is not suited to the present application for a plastic molded puck. First, the teeth of the Tanaka pin are aligned substantially along a single plane substantially perpendicular to a central axis passing concentrically through the head of the pin, as well as nearly parallel to the peripheral wall of the shank. Thus, the tip of the pin is almost one half of the total diameter of the total diameter of the shank of the pin when joined together. Such a configuration teaches away from the structure of the present invention; moreover, Tanaka fails to describe or teach the use of a reduced tip size as an important factor in the insertion of quality runners or glide pins during the manufacturing process of a puck to increase the useful life of the puck.

Other patents describing pins for binding loose leaves which suffer from the above described and other disadvantages include U.S. Pat. No. 2,201,551 issued to Welk and U.S. Pat. No. 1,418,314 issued to McBee. An toothed insulator is shown in U.S. Pat. No. 607,315 issued to Wingard, and an inclined split bolt is shown in U.S. Pat. No. 150,060 issued to Lapham.

Clearly, the above demonstrates a need for a game puck including an improved glide pin. None of the above references, taken alone or in combination, are seen as teaching or suggesting the presently claimed game puck.

SUMMARY OF THE INVENTION

The present invention overcomes the limitations of the above inventions by providing a diagonally split pin and game puck combination. The shell has a plurality of throughbores (or apertures) radially disposed and interposed between the upper and lower faces of the puck. An oversized, two-piece glide pin is received in each throughbore. Each piece has teeth that align and interengage when the glide pin is assembled in a throughbore.

The pin is provided having a diagonally split shank defining a plurality of mating teeth and a predetermined total shank diameter when joined. Each resulting component has an inclined toothed or serrated surface which mates with a like component, each component having a tip diameter which is substantially less than one-half of the diameter of the total shank diameter. Thus when a pair of pin components are abutted at the tip, a reduced diameter is defined which approximates one half or less of the total shank diameter. This diameter permits insertion of a pin component into each mouth of a puck aperture and joinder of the pin in a manner which, first, as the tips abut, permit a large margin of space to avoid insertion damage at the mouth of the aperture, and, second, as the tips are driven by one another in opposing directions, cause the pin to reach a total shank diameter that not only matches the aperture diameter, but may actually slightly exceed the diameter of the aperture to the extent of micrometer tolerances.

The oversized pins may locally bulge the material about the receiving throughbore and generate annular flat spots between neighboring pins. Each glide pin has a first head that protrudes beyond the upper face and a second head that protrudes beyond the lower face. The puck traverses the street hockey playing surface with minimal friction on the heads of the glide pins.

In consideration of the above, an object of the invention is to provide a game puck that has a split pin having a configuration suited to the molded manufacture of a puck.

A further object of the invention is to provide a game puck that includes glide pins with heads that contact the playing surface, enhancing the sliding capabilities of the puck.

An additional object of the invention is to provide a game puck includes interchangeable glide pins with teeth that self align and interengage when received in the game puck.

Yet a further object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 1:
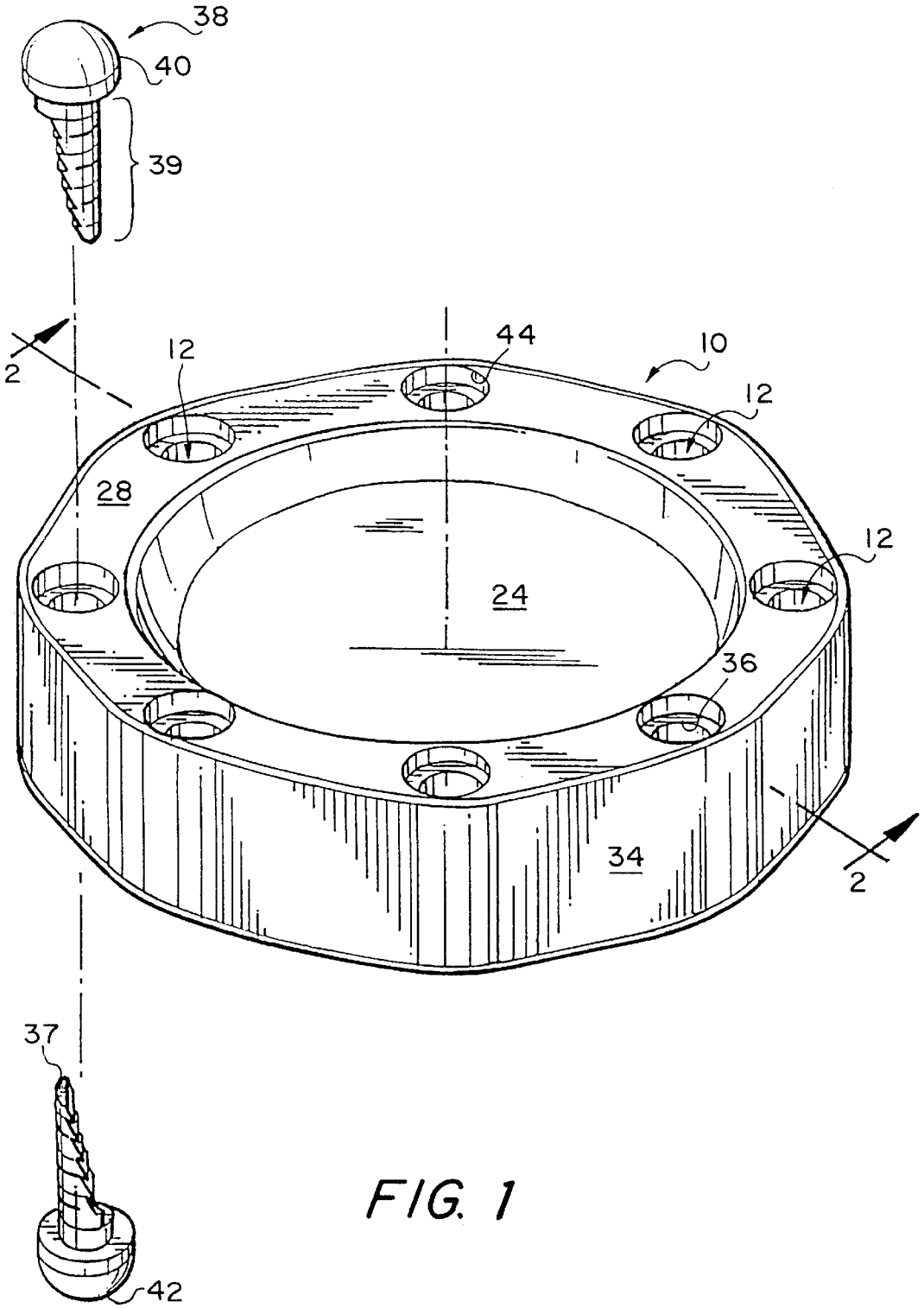
FIG. 1 is a partially exploded, top front perspective view of a first embodiment of a split glide pin in combination with a game puck.
Figure 2:
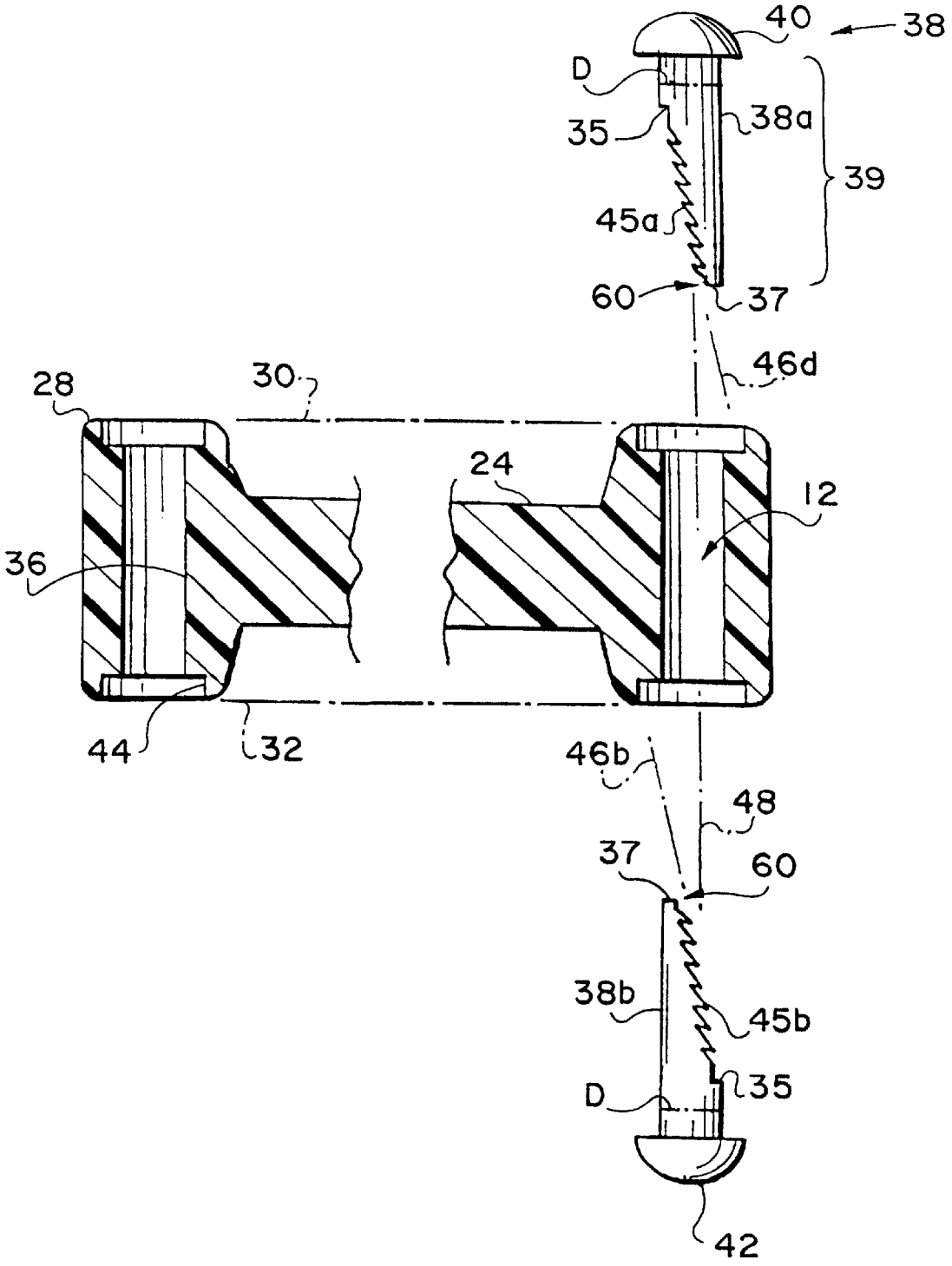
FIG. 2 is a longitudinal cross-sectional detail view of the invention drawn along lines 2—2 of FIG. 1, the game puck body being fragmented to show indefinite size, and illustrating the first embodiment of the glide pin.
Figure 3:
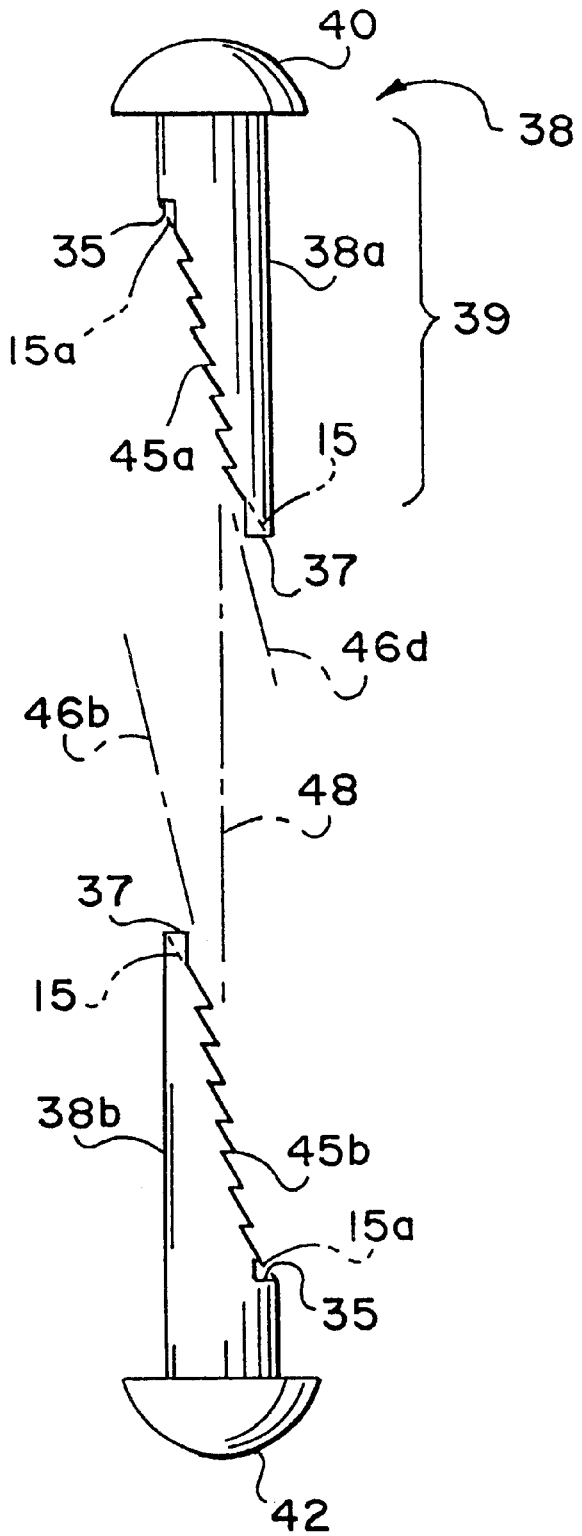
FIG. 3 is a side elevational view of a second embodiment of the glide pin.

Referring to FIGS. 1 through 3, the invention includes a disc-shaped puck body 10 having a plurality of throughbores or apertures 12. The puck body 10 is constructed from polyvinylchloride, "PVC" hereinafter, formulated with high- and low-temperature plasticizers. The plasticizers maintain relatively constant durometer within the PVC between temperatures of 50° through 100° Fahrenheit (F). Maintaining constant durometer in a material through a range of temperatures provides desirable constant density, deflection and expansion properties. These consistent properties provide street hockey players with a puck having predictable playing characteristics. A puck having predictable playing characteristics reduces the variables players must master. Limiting the number of variables permits players to improve their skills rapidly.

In FIG. 1, a representative game puck body 10 is shown with a first embodiment of a glide pin 38 being received in the throughbore 12. The puck body 10 includes a shell 28 that circumscribes and joins a center film 24. Preferably, the puck body 10, center film 24 and shell 28 define an upper face 30, a lower face 32 and an annular surface 34. When force is applied to the shell 28, the shell 28 urges the center film 24 to compress. However, the center film 24 is purposed at absorbing impact and providing the brunt of the rebound action.

Preferably, the puck body 10, center film 24 and shell 28 are integrally constructed. Integral construction permits large-scale injection molding that is inherently less expensive than production and assembly of multiple parts. The shell 28 may be fabricated such that it deforms on impact, as described in U.S. Pat. No. 5,275,410, discussed supra.

The shell 28 has a plurality of throughbores 12, defining an interior wall 36, the throughbores 12 radially spaced about and interposed between the upper face 30 and lower face 32 of the puck. A glide pin 38 is received in each throughbore 12.

As best seen in FIG. 2, the glide pin 38 is a split pin of bipartite construction. The pin 38 is shown having a first head 40, which protrudes beyond the upper face 30, and a second head 42, which protrudes beyond the lower face 32. Each head 40 and 42 has a larger diameter than the throughbore 12 receiving the glide pin 38, to assure that the glide pin 38 does not pass through the puck. Each head 40 and 42 is shown received in a counterbore 44 at each end of and coincident with each throughbore 12. The counterbores 44 lend stability to the glide pin 38 and lessen the effect of the shear force on the pin 38. Moreover, were the glide pin 38 not thus securely held in place, the pin would vibrate as the puck traverses a coarse playing surface, dissipating the kinetic energy of the puck and reducing the desired play speed.

The glide pin 38 is constructed from hard thermal plastic polymer with a durometer within the range of 70 to 100 shore on the "D" scale. Additionally, the polymer includes 5 to 40 percent fiber fill to enhance stiffness as is well known in the art of polymerization. Material having this durometer generally has enhanced lubricity, a characteristic which is exploited to considerable benefit. The enhanced lubricity reduces the coefficient of friction between the glide pin 38 and a playing surface, providing faster play. The plastic also allows a glide pin 38 to be replaced by clipping off one of the heads 40 or 42 and inserting a new glide pin 38. Glide pins 38 having different durometers and lubricity characteristics may be inserted in each throughbore 12 to provide the puck a variety of friction coefficients for different playing surfaces.

As best seen in FIGS. 2 and 3, the glide pin 38 is shown formed from two shank members, 38*a* and 38*b*, joining heads 40,42, respectively. The pin 38 is thus provided having a diagonally split shank 39 defining a plurality of mating teeth 45*a*,45*b* and a predetermined total shank diameter, when the component parts 38*a*,38*b* are fully joined. The predetermined total shank diameter may equal or slightly exceed that of the aperture diameter, and is represented by line D.

Each mating shank member has an inclined toothed or serrated surface which mates with its mating component. Any style or shape of tooth may be chosen, such as a plurality of teeth forming a serrated incline, or, in the alternative, a serpentine incline; however, the serrated incline is preferred. Each shank member 38*a* and 38*b* has teeth 45*a* and 45*b*, respectively, disposed on planes 46*d* and 46*b*, respectively, at a predetermined angle relative to the longitudinal axis 48 of the glide pin 38. The predetermined angle is preferably in the range of 5 to 20 degrees from the longitudinal axis. The teeth 45*a* and 45*b*, when the planes 46*d* and 46*b* are urged to mate, interengage, permanently securing the glide pin 38 in its respective throughbore 12. Each shank member tapers along its imaginary incline plane 46*d* or 46*b* from proximate the head 40 to a tip end 60 including a first tooth. Each shank member 38*a*,38*b* has a maximum tip diameter through the tooth which is substantially less than one-half of the total shank diameter D. The preferred diameter of tip end 60 is less than one-third of the total shank diameter D.

Thus, in the preferred embodiment, when a pair of shank members 38*a*,38*b* are abutted at the tip end, a reduced diameter is defined which approximates two thirds or less of the total shank diameter. This diameter permits insertion of a shank member 38*a*,38*b* into each mouth of a puck aperture 12 so that, during joinder of the shank members 38*a*,38*b*, as the tip ends 60 abut, a large margin of space between wall 36 and the tip end 60 occurs. This avoids insertion damage at the mouth of the aperture.

Moreover, as the tip ends 60 are driven past one another in opposing directions, the total shank diameter D is eventually reached when the tip ends 60 meet. Thus, the diameter of the split pin shank 39 not only matches the aperture diameter, but may actually slightly exceed the diameter of the aperture to the extent of micrometer tolerances to further add holding strength to the pin within the puck.

However two embodiments of the pin shank 39 are presented for differing functional results. In a first embodiment, each shank member 38*a* and 38*b* terminates in a blunt tip 37. When shank member 38*a* or 38*b* is fully inserted in the throughbore 12, each blunt tip 37 abuts a complementary shoulder 35 on the mating shank member 38*a* or 38*b*. The abutting shoulder 35 prevents the shank diameter D from being exceeded.

As shown in FIG. 3, in the second embodiment of the pin shank 38*a*,38*b*, the tip end 60 is modified to eliminate the blunt tip 37, and instead, continue the plane of inclination by providing an inclined tip 15, shown by phantom lines. The advantage to such an inclined tip 15 is that kinetic energy can be dissipated in the manner of a shock absorber by allowing displacement of the shank members 38*a*,38*b* in the micrometer range. The tight fit provided by the split pin 38 against the throughbore wall 36 prevents excessive outward displacement which may adversely affect the holding strength of the pin 38 within the puck body 10; in fact, inward pressure on the pin will force an increase in diameter, further binding the shank members 38*a*,38*b*.

A further characteristic of each tooth 45*a*,45*b* which provides an added advantage to the manufacture of plasticized PVC pucks is flexibility. Each tooth is preferably dimensioned and configured to a thin enough size where the material properties of which each tooth is made permits flexing sufficient to permit the passage of opposing teeth, thus limiting the outward displacement of the circumferential wall of the pin shanks 38*a*,38*b*, yet resilient enough to retain its original shape to engage an opposing tooth.

This feature is particularly important in the manufacture of plasticized PVC pucks. As noted above, the throughbore 12 is prone to enlargement by cooling of the plasticized PVC, and thus a snug fit may be difficult to achieve with prior art pins. Moreover, the molecular characteristics of plasticized PVC during the curing process also cause shrinkage, irrespective of cooling, contributing to the problem. Finally, the plasticized PVC before the final cure state has nearly no rebound properties, i.e. no resilient memory, which can result in an enlarged throughbore by virtue of the mechanical forces exerted upon wall 36 during the insertion of a pin 38. In other words, the hole is stretched and cannot return to its intended diameter.

This problem becomes particularly relevant when the tip end 60 of each shank member 38*a*,38*b* reaches the last tooth proximate the head 40,42, respectively. As the tip end 60 passes by the last tooth to reach its final position abutting shoulder 35, the circumferential wall must necessarily be displaced, pressing outwardly against the aperture wall 36. However, the teeth 45*a*,45*b*, as a whole serrated incline, should be sufficiently small-sized and flexible to prevent exceeding the threshold force which permanently enlarges the throughbore due to the non-resilient properties of the plasticized PVC at a given temperature. In commercial production of pucks using such pins having small and flexible teeth, tolerances between the pin shank and aperture wall of plus zero and minus zero have been achieved.

Figure 4:
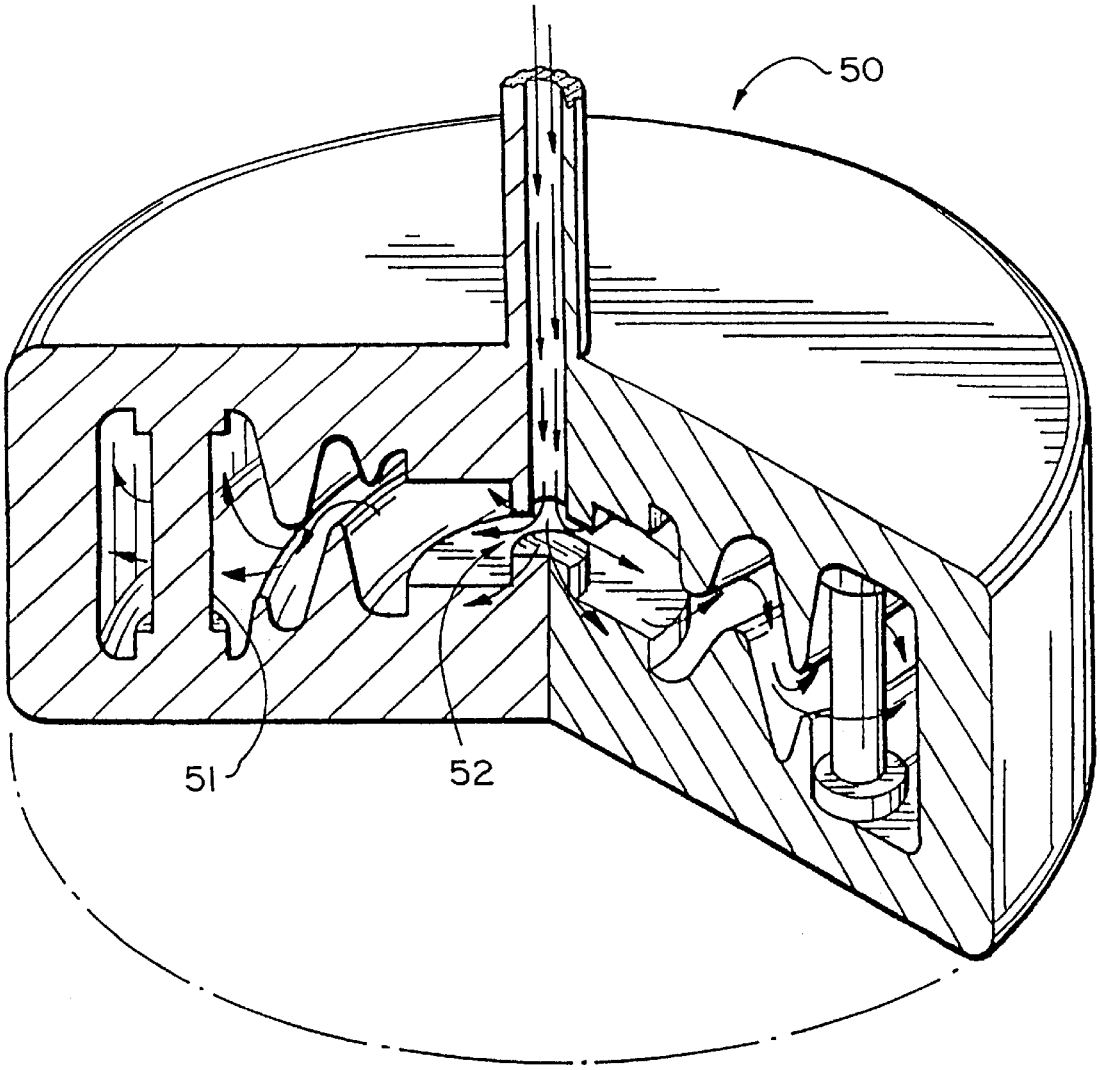
FIG. 4 is a diagrammatic view of the mold and injection direction.

Regarding the method for constructing the present game puck, and referring to FIG. 4, the invention provides a method for constructing a puck such as the one described above. The method includes providing a mold 50 having a cavity defining the outer surface of a puck. The mold 50 includes a predetermined number of casting puck bodies 51 around which the injected material must flow.

The method includes the step of injecting material into the mold 50 through a centrally-disposed fan gate 52. The central location of the fan gate 52 represents a point of novelty not found in the prior art. Typically, prior art pucks would be produced in molds having laterally-disposed gates. Hot plastic material flows from the laterally-disposed gates through the mold cavity and around the casting puck bodies therein. As the plastic flows, it cools. By the time the plastic material has reached the farthest point from the gate, the material has begun to set. This is significant in two ways.

First, the material delivered into the mold has a density proximal to the gate significantly variant from that of the material distal to the gate. Nonuniform density introduces imbalance and thermally-sensitive concentricity. Imbalance occurs when a body has nonuniform mass. A puck constructed of material with lesser and greater density portions dichotomously ordered has nonuniform mass. Thermally-sensitive concentricity occurs when, as the temperature of the body increases, the body expands in a nonuniform manner and goes out of round. Bodies having anisotropic density characteristics expand non-uniformly as temperature increases.

Second, casting puck bodies force flowing plastic material to part and form two streams. Theoretically, the streams are supposed to merge, forming a uniform mass. However, with respect to casting puck bodies distal to the gate, the plastic material has cooled considerably prior to its bifurcation. Rather than the streams merging once past the casting puck body, the skins of each stream may adhere, forming a cold joint. Cold joints introduce anisotropic characteristics in the molded body.

A player may realize the effects of imbalance, non-concentricity and/or anisotropically-diverged cold joints in the form of puck wobble, skewed trajectory and unpredictable rebounding. A cold joint also tends to fail, introducing a stress node along which the puck may crack. The present invention, by providing for a central fan gate, has a shorter distance over which to flow than a mold constructed with laterally-disposed gate. The shorter distance reduces the density discrepancies within the puck. Centrally-disposed fan gate also reduce the opportunities for cold joints to form. Even if cold joints did form, they would be isotropically-diverged within the body.

The method further includes setting the plastic material and ejecting the puck from the mold, as is well known in the art.

The present invention is not intended to be limited to the embodiments described above, but to encompass any and all embodiments within the scope of the following claims.

I claim:

1. A puck in combination with a glide pin comprising:

a puck body having an upper face, an opposing lower face, and a plurality of throughbores interposed between said upper face and said lower face, each said throughbore having a predetermined throughbore diameter; and a plurality of split glide pins, each comprising a pair of mating components, each mating component including a head for preventing passage of said glide pin through said throughbore; and a shank member, having a head end and a tip end and defining a longitudinal axis therebetween, said head end attached to said head, said shank member being tapered to define an inclined surface relative to said longitudinal axis, said inclined surface having a plurality of teeth;

wherein said shank members of said pair of mating components are engaged within said throughbore in a joined state which defines a shank of said glide pin, said shank having a predetermined shank diameter, said shank diameter is greater than said throughbore diameter; and wherein further each said tip end has a tip diameter substantially less than said one-half of the throughbore diameter, wherein further a combined tip diameter is defined when said tip ends of said pair of mating components are engaged which is substantially less than the shank diameter.

2. The puck according to claim 1, wherein said puck body is composed of a plastic composition.

3. The puck according to claim 1, wherein said combined tip diameter does not exceed two-thirds of the shank diameter.

4. The puck according to claim 1, wherein said plurality of teeth define a serrated inclined surface.

5. The puck according to claim 1, wherein said tip end has a blunt tip and wherein further said shank member defines a shoulder for receiving said blunt tip of said tip end of a mating component of said pair.

6. The puck according to claim 1, wherein said tip end has an inclined tip.

7. The puck according to claim 1, each of said glide pins being constructed with a durometer within the range of 70 to 100 shore of the "D" scale and having a fiber fill content between 5 and 40 percent.

8. The puck according to claim 1, wherein said inclined surface is disposed at an angle between 5 and 20 degrees from said longitudinal axis.

* * * * *